US005402550A

United States Patent [19]

Lessard

[11] Patent Number: 5,402,550

[45] Date of Patent: Apr. 4, 1995

[54] ARM EXTENDER

[76] Inventor: Wilfred E. Lessard, 203 Commonwealth Ave., New Britain, Conn. 06053

[21] Appl. No.: 953,895

[22] Filed: Sep. 30, 1992

[51] Int. Cl.[6] ..... A47K 7/02

[52] U.S. Cl. ..... 15/143.1; 15/144.2; 15/145; 15/244.1; 15/244.2

[58] Field of Search ..... 15/236.02, 244.1, 244.2, 15/105, 114, 143.1, 145, 227, 144.4

[56] References Cited

U.S. PATENT DOCUMENTS

| | | | |
|---|---|---|---|
| 3,116,502 | 1/1964 | Gerber | 15/227 X |
| 3,407,424 | 10/1968 | Lanzarone et al. | 15/144.4 X |
| 3,491,397 | 1/1970 | Hesenor | 15/244.2 X |
| 4,099,289 | 7/1978 | Bretthauer | 15/244.1 |
| 4,571,766 | 2/1986 | Goldman et al. | 15/244.1 X |
| 4,642,836 | 2/1987 | Bokmiller | 15/114 X |
| 4,813,458 | 3/1989 | Jacobucci | 15/236.02 |
| 4,962,561 | 10/1990 | Hamilton | 15/111 |

FOREIGN PATENT DOCUMENTS

| | | | |
|---|---|---|---|
| 187266 | 10/1956 | Austria | 15/244.1 |
| 907102 | 10/1962 | United Kingdom | 15/244.1 |

*Primary Examiner*—Chris K. Moore

[57] ABSTRACT

An arm extender, in accordance with the present invention, comprises a pair of spaced curved extending members which are joined at one end by a connecting member. Further, a bracket for mounting a sponge is pivotably attached to the connecting member. A sponge having an opening is disposed about the bracket and retained thereon by, for example, a Velcro ® type attachment. A gripping member is connected between the extending members at a predetermined distance from the free end of the extending members. Also, a strap is provided near the free end of the extending members for securing the arm extender to a person's arm. The strap is secured to at least one of the extending members and wraps about the other extending member forming a loop therebetween whereupon the strap is attached onto itself. During use, the user grips the gripping member with the user's hand and the user's forearm is secured within the loop of the strap. The strap is attached by, for example, a Velcro ® type attachment. The extending, gripping and connecting members are preferably comprised of a light weight plastic. Also, the gripping member and the portions of the extending members in contact with the user's forearm may be padded.

10 Claims, 2 Drawing Sheets

ARM EXTENDER

BACKGROUND OF THE INVENTION

The present invention relates to devices for extending the reach of a person's arm. More particularly, the present invention relates to an arm extending device having a sponge disposed at one end thereof for washing hard to reach areas of motor vehicles (e.g., sport utility vehicles, trucks, etc.).

Poles and similar devices have been used to extend the reach of a person's arm for many purposes. However, poles and similar devices tend to be difficult to control, particularly with longer lengths. Accordingly, there is a continuing need for devices which will extend the reach of a person's arm without sacrificing control.

SUMMARY OF THE INVENTION

The above-discussed and other problems and deficiencies of the prior art are overcome or alleviated by the arm extender of the present invention. In accordance with the present invention the arm extender comprises a pair of spaced curved extending members which are joined at one end by a connecting member. Further, means for mounting a sponge is pivotably attached to the connecting member. A sponge having an opening is disposed about the mounting means and retained thereon by retaining means (e.g., a Velcro® attachment). A gripping member is connected between the extending members at a predetermined distance from the free end of the extending members. Also, means for securing the arm extender to a person's arm is provided near the free end of the extending members. The securing means may comprise an elastic strap having attachment means. The strap is secured to at least one of the extending members and wraps about the other extending member forming a loop therebetween. During use, the user grips the gripping member with the user's hand and the user's forearm is secured within the loop of the securing means. The attachment means may comprise a Velcro® type attachment, snaps or any other well known means. The extending, gripping and connecting members are preferably comprised of a light weight plastic. Also, the gripping member and the portions of the extending members in contact with the user's forearm may be padded.

The arm extender provides easy access for washing of roof tops of motor vehicles (such as sport utility vehicles, trucks, etc.) which in the past have been difficult to wash.

This device may also be useful in cleaning hard to reach areas in the home (e.g., cleaning outside and behind toilets, floor areas, inside cabinets, ceiling fans and under radiators). Further, this device may aid persons that have difficulty in bending to reach many of the aforementioned areas.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 2:
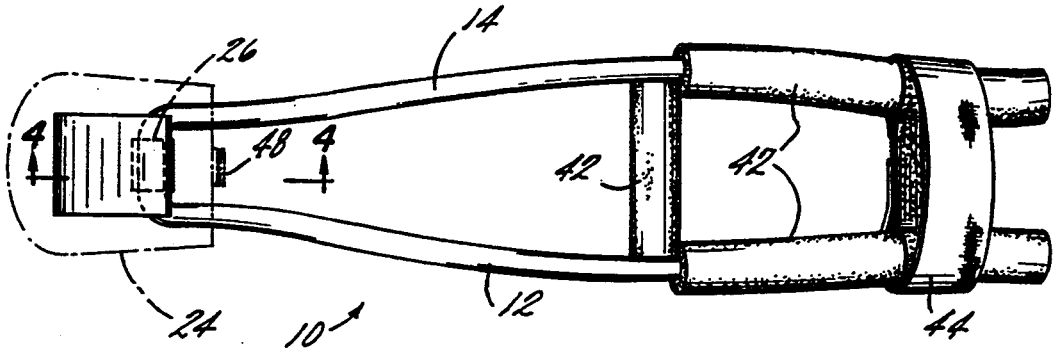
FIG. 2 is a top view of the arm extender of FIG. 1.
Figure 1:
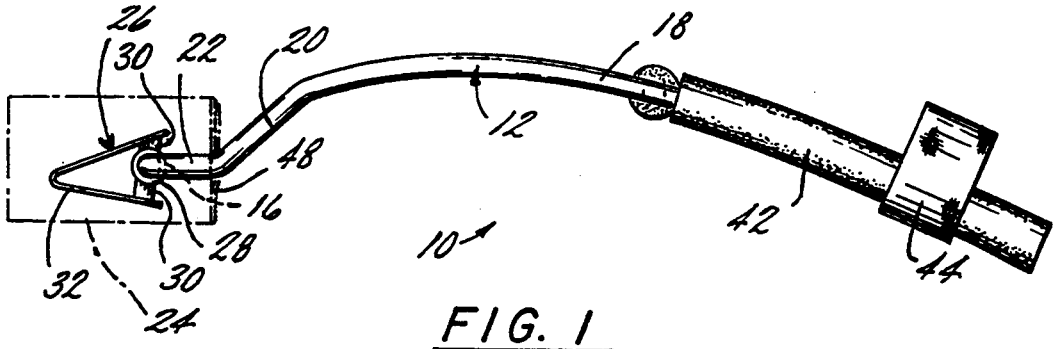
FIG. 1 is a side elevational view of the arm extender in accordance with the present invention without a sponge.
Figure 3:
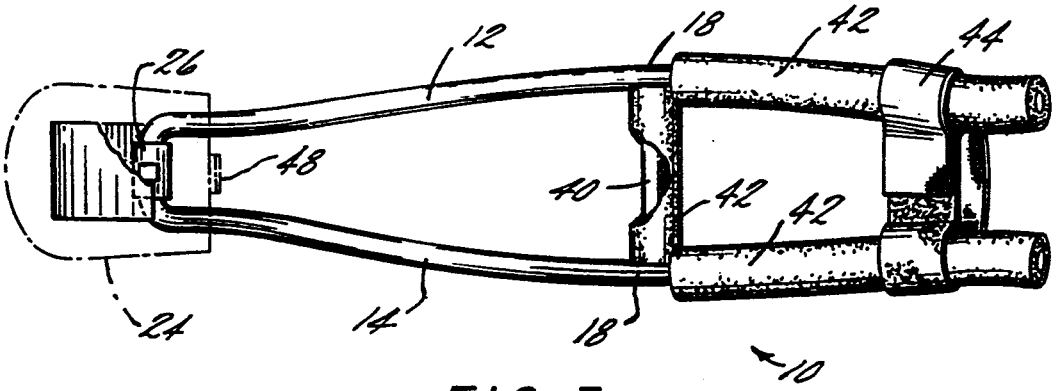
FIG. 3 is a bottom view of the arm extender of FIG. 1.

Referring to FIGS. 1-3, an arm extender is shown generally at 10 with a sponge (shown in phantom) so that the details of the arm extender can be more clearly shown. Arm extender 10 comprises a pair of spaced curved extending members 12 and 14 which are joined at one end by a connecting member 16. Each member 12 and 14 comprises a gradually curved portion 18 extended from a free end of the member along a substantial portion of its length, a more prominent downwardly curved portion 20 depends from portion 18 and a relatively straight portion 22 depends outwardly from portion 20 and connects with member 16. Members 12, 14 and 16 may be individual pieces connected by any well known means (e.g., adhesive or rotary connection) or may be a single continuous piece. Also, members 12, 14 and 16 are preferably comprised of a light weight plastic which are preferably tubular in construction.

Figure 5:
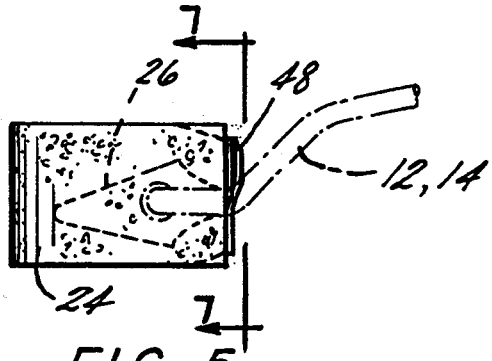
FIG. 5 is a partial side elevational view of the arm extender of FIG. 1 with the sponge disposed thereon in accordance with the present invention.
Figure 4:
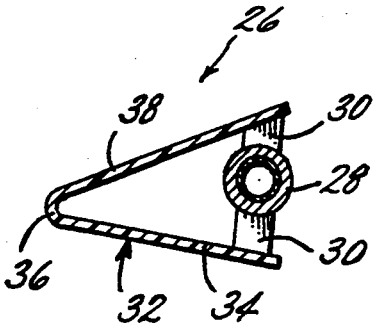
FIG. 4 is a side elevational view of the mounting means of the arm extender of FIG. 1.

A sponge 24 (FIG. 5) is disposed at connecting member 16 by mounting means 26. Mounting means 26 (FIG. 4) comprises annular portion 28 pivotably disposed about connecting member 16. Annular portion 28 is connected by extensions 30 to a mounting plate 32. Plate 32 comprises a first straight portion 34 connected to portion 28 by one of the extensions 30, an arcuate portion 36 depending from one end of portion 34 and a second straight portion 38 depending from one end of portion 36 and connected to portion 28 by the other one of the extensions 30. Portion 38 is angled relative to portion 34 whereby connecting member 16 is disposed between portions 34 and 38. Plate 32 is resilient and preferably comprised of a plastic. Further, it is preferred that portion 28, extensions 30 and plate 32 are a continuous single piece of plastic, however mounting means 26 may be comprised of individual pieces.

A gripping member 40 is connected between members 12 and 14 at portions 18. Member 40 is preferably integrally formed with members 12 and 14, however member 40 may be a separate piece which is attached by any known means. Member 40 is positioned to be gripped by a user's hand so that a length of each portion 18 lies adjacent to the user's forearm to provide support for the arm extender 10 during use. Preferably, member 40 and the length of each portion 18 adjacent to the user's forearm are padded with padding 42 (e.g., foam rubber).

A strap 44 is secured (e.g., sewn, ultrasonic weld, or a loop/hook Velcro® type attachment) about at least one of members 12 and 14 at portion 18 (over padding 42 if present). During use, the free end of strap 44 is wrapped over the user's forearm, around the outside of the other portion 18, under the user's forearm and the free end is attached to the secured end by attachment means. Attachment means may comprise a snap connector or preferably a loop and hook (i.e., Velcro ®) type attachment, whereby the secured end of strap 44 has a plurality of hooks on the outwardly facing surface thereof and the free end of strap 44 has a plurality of loops on the inwardly facing surface thereof for mating with the hooks. While such attachment means are preferred, strap 44 may be a continuous elastic loop disposed about portions 18 of members 12 and 14, whereby the user's forearm is secured within this loop between members 12 and 14 by the elastic characteristics of strap 44.

Figure 7:
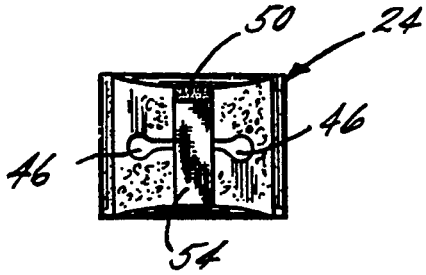
FIG. 7 is a view taken along the line 7—7 in FIG. 5.
Figure 6:
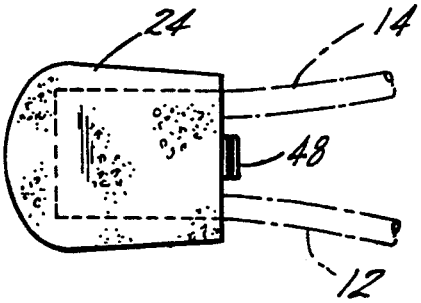
FIG. 6 is a partial top view of the arm extender of FIG. 5.
Figure 8:
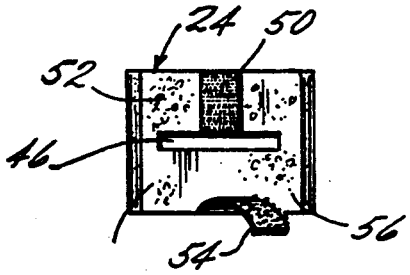
FIG. 8 is a end view of the sponge of FIG. 5.

Referring now to FIGS. 5–8, arm extender 10 is shown with sponge 24 mounted on mounting means 26. Sponge 24 has an opening 46 at one end thereof. Mounting means 26 is disposed in opening 46 whereby portions 34 and 38 exhert a restraining force on sponge 24. Sponge 24 is further retained by a retaining means 48 which preferably comprises a hook and loop Velcro ® type attachment. A first strap 50 is attached at one end by any well known means (e.g., sewn, adhesive, ultrasonic weld) to an upper half 52 of sponge 24. Strap 50 has a plurality of loops on one of its surfaces. At least one end of a second strap 54 is attached to a lower half 56 of sponge 24. Strap 54 has a plurality of hooks on one of its surfaces. The loops and hooks engage as shown in FIG. 7 to retain sponge 24 on arm extender 10. Straps 50 and 54 prohibit movement of sponge 24 beyond member 16. Retaining means 48 may comprise snaps or any other known means for retaining sponge 24 on arm extender 10. Retaining means 48 also allows for easy replacement/removal of sponge 24.

Figure 9:
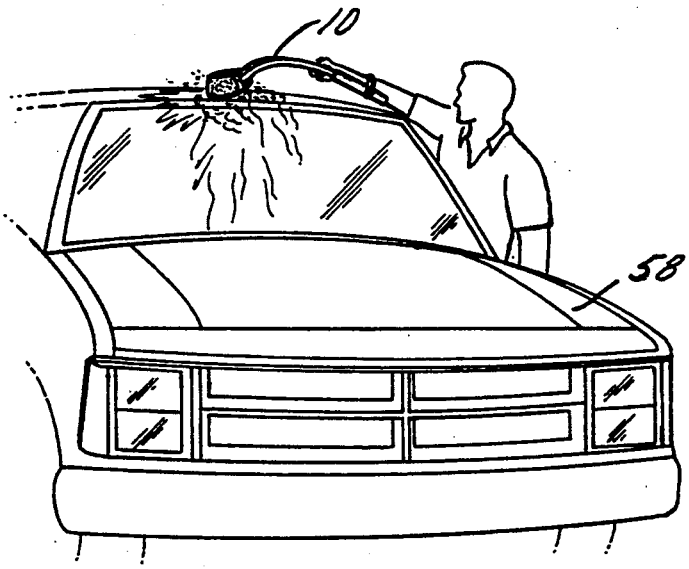
FIG. 9 is a perspective view of the arm extender of FIG. 1 being used to wash to roof of a sport utility vehicle.

Referring to FIG. 9 wherein arm extender 10 is shown being used to wash the roof of a sport utility vehicle 58. Arm extender 10 is held at gripping member 40 and by strap 44 as described hereinbefore. The ease with which the user can now reach all areas of the roof of vehicle 58 is readily appreciated by the illustration of FIG. 9.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An arm extending device comprising:

a pair of extending members each having first and second ends, each of said extending members being curved along a substantial portion of its length between said first and second ends, said first ends of each of said extending members being connected to define a connected end;

mounting means disposed at said connected end of said extending members;

a sponge removably disposed on said mounting means;

a gripping member connected between said extending members at a predetermined distance from said second ends of said extending members; and a strap having attachment means thereon, said strap having a length sufficient for wrapping about both of said extending members with a user's forearm disposed therebetween at a location between said gripping members and said second ends of said extending members, wherein said strap is attached onto itself by said attachment member.

2. An arm extending device comprising:

a pair of extending members each having first and second ends, each of said extending members being curved along a substantial portion of its length between said first and second ends, said first ends of each of said extending members being connected to define a connected end;

mounting means disposed at said connected end of said extending members;

a sponge removably disposed on said mounting means;

a gripping member connected between said extending members at a predetermined distance from said second ends of said extending members; and a connecting member connected between said extending members;

said mounting means comprising:

an annular portion pivotably disposed about said connecting member;

first and second extensions, each connected at one end thereof to said annular portion;

a first generally straight plate portion connected to the other end of said first extension;

an arcuate plate portion depending at one end thereof from one end of said first plate portion; and a second generally straight plate portion connected to the other end of said second extension, said second plate portion depending at one end thereof from the other end of said arcuate plate portion, wherein said second plate portion is disposed at an angle relative to said first plate portion whereby said connecting member is disposed between said first and second plate portions.

3. The device of claim 1 wherein said attachment means comprises:

a plurality of loops disposed on at least a portion of one surface of said strap at one end thereof; and a plurality of hooks disposed on at least a portion of one surface of said strap at the other end thereof, whereby said loops and hooks engage to attach said strap onto itself.

4. The device of claim 1 wherein said strap is secured to at least one of said extending members.

5. An arm extending device comprising:

a pair of extending members each having first and second ends, each of said extending members being curved along a substantial portion of its length between said first and second ends, said first ends of each of said extending members being connected to define a connected end;

mounting means disposed at said connected end of said extending members;

a sponge removably disposed on said mounting means, said sponge including an opening at one end thereof, said mounting means disposed in said opening;

retaining means for removably retaining said sponge on said mounting means;

a gripping member connected between said extending members at a predetermined distance from said second ends of said extending members; and wherein said opening in said sponge defines upper and lower portions; and wherein said retaining means comprises:

a first strap attached to said upper portion of said sponge; and a second strap attached to said lower portion of said sponge, said first and second straps having attachment means thereon.

6. The device of claim 5 wherein said attachment means comprises:

a plurality of loops disposed on at least a portion of one surface of one of said first and second straps; and a plurality of hooks disposed on at least a portion of one surface of the other of said first and second straps, whereby said loops and hooks engage to attach said first and second straps.

7. An arm extending device comprising:

a pair of curved extending members each having first and second ends, a connecting member connected between said first ends of said extending members;

an annular portion pivotably disposed about said connecting member;

first and second extensions, each connected at one end thereof to said annular portion;

a first generally straight plate portion connected to the other end of said first extension;

an arcuate plate portion depending at one end thereof from one end of said first plate portion;

a second generally straight plate portion connected to the other end of said second extension, said second plate portion depending at one end thereof from the other end of said arcuate plate portion, wherein said second plate portion is disposed at an angle relative to said first plate portion whereby said connecting member is disposed between said first and second plate portions;

a sponge having an opening at one end thereof, said first and second plate portions disposed in said opening to retain said sponge thereon; and a gripping member connected between said extending members at a predetermined distance from said second ends of said extending members.

8. The device of claim 7 further comprising:

a strap having attachment means thereon, said strap having a length sufficient for wrapping about both of said extending members with a user's forearm disposed therebetween at a location between said gripping member and said second ends of said extending members, wherein said strap is attached onto itself by said attachment means.

9. The device of claim 7 further comprising:

a first pad disposed about said gripping means; and second and third pads disposed about each of said extending members respectively at a location between said gripping member and said second ends of said extending members.

10. The device of claim 7 wherein said extending members and said gripping member are comprised of a tubular plastic member.

* * * * *